United States Patent [19]

Hartig et al.

[11] 4,237,832

[45] Dec. 9, 1980

[54] PARTIAL-LOAD CONTROL APPARATUS AND METHOD AND FOR INTERNAL COMBUSTION ENGINES

[75] Inventors: Fritz Hartig, Olching; Reinhard Hofmann, Fürstenfeldbruck, both of Fed. Rep. of Germany

[73] Assignee: Bayerische Motoren Werke Aktiengesellschaft, Fed. Rep. of Germany

[21] Appl. No.: 938,956

[22] Filed: Sep. 1, 1978

[30] Foreign Application Priority Data

Sep. 6, 1977 [DE] Fed. Rep. of Germany ..... 2740045

[51] Int. Cl.[3] ..... F02B 75/12; F02B 75/02; F02M 25/06

[52] U.S. Cl. ..... 123/59 EC; 123/64; 123/75 C; 123/198 F

[58] Field of Search ..... 123/64, 59 EC, 59 BM, 123/198 DB, 198 F, 198 DC, 75 C, 119 A

[56] References Cited

U.S. PATENT DOCUMENTS

| | | | |
|---|---|---|---|
| 2,113,602 | 4/1938 | Pratt | 123/59 EC |
| 2,420,136 | 5/1947 | Hill | 123/64 |
| 3,702,111 | 11/1972 | Weaving et al. | 123/75 C |
| 3,789,807 | 2/1974 | Pinkerton | 123/59 EC |
| 4,086,882 | 5/1978 | McCrum | 123/59 EC |

*Primary Examiner*—Craig R. Feinberg
*Attorney, Agent, or Firm*—Craig & Antonelli

[57] ABSTRACT

Partial load control apparatus and method for internal combustion engines with internal combustion in several engine working spaces, in which with a decreasing load the number of working strokes with internal combustion is reduced per time unit; for that purpose an increasing number of the working spaces are changed-over to an after-expansion operation which includes a number of displacement and after-expansion cycles divisible by two, whereby the working gas which has only incompletely expanded in the non-changed-over working spaces during a respective working stroke with internal combustion, is fed to the changed-over working spaces in lieu of a fresh mixture and is further expanded within these changed-over working spaces.

5 Claims, 10 Drawing Figures

PARTIAL-LOAD CONTROL APPARATUS AND METHOD AND FOR INTERNAL COMBUSTION ENGINES

BACKGROUND AND SUMMARY OF THE INVENTION

The present invention relates to a method and apparatus with partial load control of internal combustion engines with internal combustion in several working spaces, in which with a decreasing load, the number of working or power strokes with internal combustion is reduced per time unit.

With a known method of this type (German Offenlegungsschrift No. 18 06 695), certain cylinders, for the purpose of control in the partial load range, are cut off from the fuel supply in a predetermined cycle sequence depending on the magnitude of the desired partial load. As a result thereof, the charge exchange work which is unfavorable from a fuel consumption point of view, can be reduced overall. However, in that case also the cylinders which are not supplied with fuel have to produce charge exchange work. In order to reduce the proportion of the charge exchange work which fall on the latter cylinder, methods are known in the prior art in which the valves of the corresponding cylinders are rendered inoperable, i.e., are halted.

The present invention is concerned with the task to further improve the efficiency with a method of the type described hereinabove.

The underlying problems are solved according to the present invention in that an increasing part of the working spaces are changed-over to an after-expansion operation which includes a number of displacement- and after-expansion cycles divisible by two, whereby the operating gas which is only incompletely expanded in the non-changed-over working spaces in a respective working cycle, is fed to the changed-over working spaces instead of a fresh mixture and is continued to be expanded within the same or in that with a decreasing load all working spaces are changed-over increasingly to a higher number of cycles or strokes, whereby an increasing number of after-fill and after-expansion stroke pairs follows a respective operating cycle containing a power stroke with internal combustion engine.

The method according to the present invention is preferably suitable for internal combustion engines with quantity control.

Accordingly, it is an object of the present invention to provide a method for the partial load control of internal combustion engines which avoids by simple means the aforementioned shortcomings and drawbacks encountered in the prior art.

Another object of the present invention resides in a method for the partial load control of internal combustion engines in which the efficiency is improved.

A further object of the present invention resides in a method for the partial load control of internal combustion engines in which wasted charge-exchange work is minimized.

Still another object of the present invention resides in a method for the partial load control of internal combustion engines which is highly reliable in operation, yet is simple and can be realized by controls known as such in the prior art.

These and other objects, features, and advantages of the present invention will become more apparent from the following description of two preferred methods for the partial load control of internal combustion engines in accordance with the present invention.

The method for the partial load control of internal combustion engines with quantity control and with internal combustion in several working spaces essentially consists in that with a decreasing load the number of working or power strokes with internal combustion is increasingly reduced per time unit in favor of subsequent after-expansion strokes.

In one method of this type according to the present invention, an increasing number of the working spaces is changed-over with a decreasing load to an at least two-cycle after-expansion operation whereby the working gas which is only incompletely expanded in the non-changed-over working spaces is fed to the changed-over working spaces in lieu of a fresh mixture and is continued to be expanded within the same.

Either two or more working spaces thereby operate directly together or an intermediate storage device is used by way of which the working spaces cooperate.

Depending on the construction of the internal combustion engine, the possibility of a single or multiple after-expansion with corresponding higher stroke numbers exists with the present invention.

In a second method of this type according to the present invention, all working spaces are changed-over with a decreasing load to an increasing stroke or cycle number, whereby each working cycle or power stroke is enlarged by a number of refill and after-expansion strokes divisible by two.

Preferably both methods can be carried out by separate valves by means of a separation of the exhaust into high pressure pre-exhaust and low pressure exhaust.

Therebeyond, the exhaust gas emission can be reduced in that during the working strokes with internal combustion engine, a rich mixture is used for the $NO_X$ decrease and additional air is blown in for the after-expansion so that simultaneously an after-oxidation of the uncombusted components takes place which is favorable from an efficiency point of view.

The present invention is also concerned with the internal combustion engine apparatus for carrying out the above-discussed novel methods of engine operation.

These and other objects, features, and advantages of the present invention will become more apparent from the following description when taken in connection with the accompanying drawing which shows, for purposes of illustration only, several embodiments in accordance with the present invention, and wherein:

DETAILED DESCRIPTION OF THE DRAWINGS

Figure 1A:
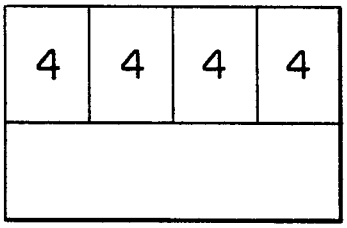
FIGS. 1*a* to 1*d* are schematic views of a four-cylinder combustion engine which show different operational modes of the engine in accordance with a first preferred embodiment of the invention.
Figure 1B:
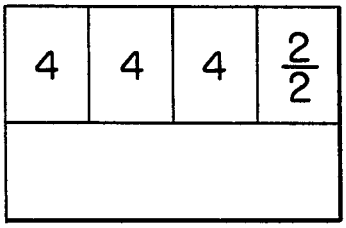

FIGS. 1*a* to 1*d* schematically depict the mode of operation of a four-cylinder engine in accordance with a first preferred method of the present invention. In FIG. 1*a*, the numerals "4" depict four-cycle combustion operation in all of the four engine cylinders. When operating in this phase depicted in FIG. 1*a*, the engine reaches its maximum power output. With a lower power requirement, the present invention contemplates switching over one of the four cylinders to an after-expansion method of operation, schematically depicted in FIG. 1*b*, with the 2/2 indicating that this right hand cylinder operates with two after-expansion strokes, while the other three cylinders operate with the ordinary four-stroke combustion operation. Filling for the changed-over cylinder (right-hand cylinder in FIG. 1*b*) is taken directly from one or more of the three other cylinders and led to the changed-over cylinder according to certain preferred embodiments of the invention. Alternative embodiments of the invention are contemplated which include an intermediate storage device, into which the three unchanged cylinders as depicted in FIG. 1*b* release part of their exhaust.

Figure 1C:
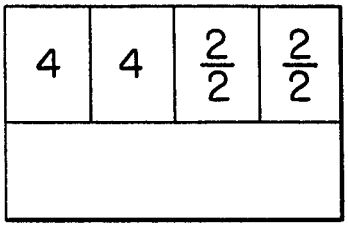

With a still lower power requirement, a second cylinder will be changed from the ordinary four-stroke operation to a double two-stroke after-expansion operation, as schematically depicted in FIG. 1*c*. In practicing this phase of the method of the invention, the four-stroke operating cylinders can be connected directly with the two-stroke operating cylinders, or they may alternatively be interconnected via an intermediate storage device.

Figure 1D:
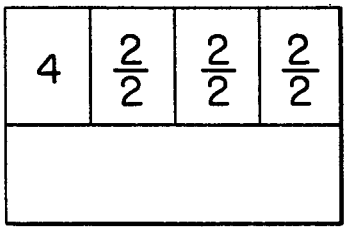

When an especially low power requirement is placed on the combustion engine, all of the cylinders except one can be changed over to after-expansion operation, as schematically depicted in FIG. 1*d*. In practicing this phase of the method of the invention, it is especially preferable to use an intermediate storage device for the filling gases which would then be taken from the single cylinder (left-hand cylinder) for accommodating the three other cylinders.

Figure 2A:
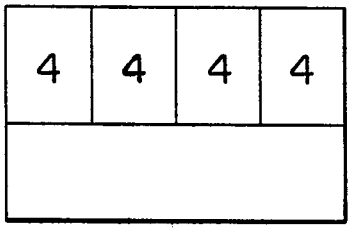
FIGS. 2*a* to 2*c* are schematic views of a four-cylinder combustion engine which show different operational modes of the engine in accordance with a second preferred embodiment of the invention.
Figure 2B:
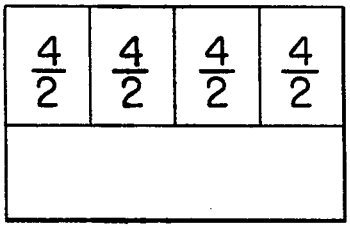
Figure 2C:
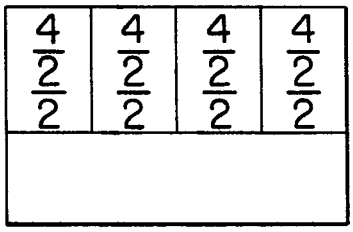

Another preferred embodiment of the method of the present invention for part-load control of the combustion engine is schematically depicted in FIGS. 2*a* to 2*c*. In FIG. 2*a*, all four cylinders are operated in the four-stroke combustion process with maximum power output. With decreasing power requirements, all of the four cylinders are changed over to a sequence of operations wherein a four-stroke combustion operation is followed with two strokes for after-expansion operation, with a resultant six-stroke operation schematically depicted as 4/2 in FIG. 2*b*. With even further reductions in the power requirements, the method of the invention includes following the four-stroke combustion cycle in each of the cylinders, with multiple after-expansion of the working gas. In this way, by means of an eight-stroke operation (4/2)/2, power can be reduced with a high degree of efficiency. In practicing the method of engine control depicted and described with respect to FIGS. 2*a* to 2*c*, either of the preferred engine embodiments with direct connection of the working gas between cylinders, and with an intermediate storage device, can be used.

Figure 3:
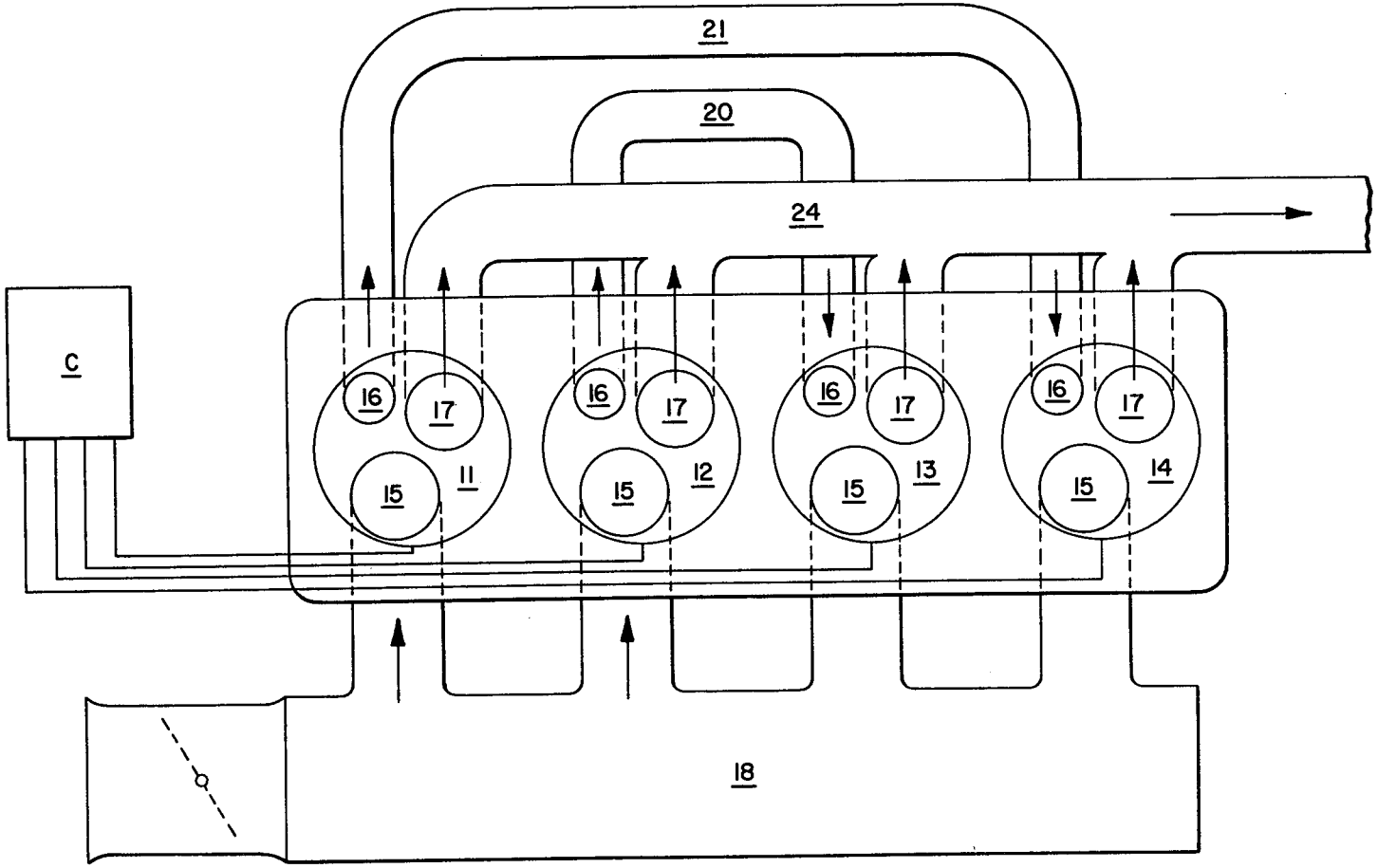
FIG. 3 is a schematic view of an engine constructed in accordance with a first preferred embodiment of the present invention.

FIG. 3 schematically depicts an internal combustion engine constructed in accordance with a first preferred embodiment of the invention. Engine 10 includes four cylinders 11, 12, 13, and 14. Each of the cylinders includes an intake valve 15, a high-pressure pre-discharge/after-intake valve 16, and a low-pressure main discharge valve 17. Intake valves 15 of all of the cylinders are connected to a suction collector or manifold 18. Pre-discharge valves 16 of cylinders 11 and 12 and after-intake valves 16 of cylinders 13 and 14 are interconnected via the respective conduits 20 and 21. Schematically depicted control apparatus C (FIG. 3) controls the operation of the engine and valves. Since one skilled in the art should be able to practice the invention given the present disclosure of the intended sequence of operations and the state of the art, further details of the control apparatus C are dispensed with.

Figure 4:
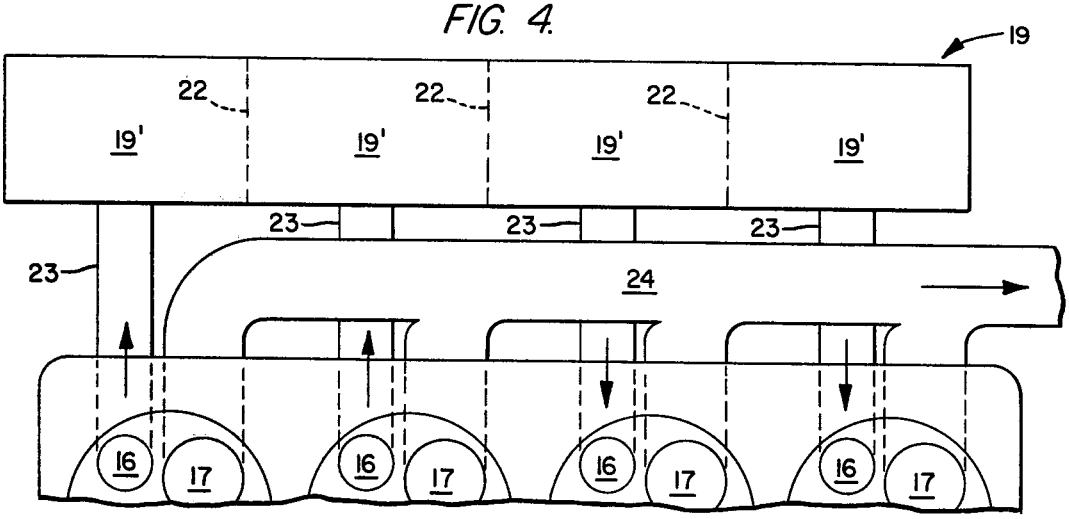
FIG. 4 is a partial schematic view showing a modified version of the means interconnecting the high pressure valves of the engine of FIG. 3.

FIG. 4 schematically depicts an alternative arrangement wherein, in lieu of the conduits 20 and 21 directly connecting the valve 16, an intermediate storage device 19 is provided. In yet other preferred embodiments of the invention, especially where there is a large number of working strokes carried out by the pistons in the cylinders, the intermediate storage device 19 can be provided with partitions 22 to form individual intermediate storage devices 19' (partitions 22 being depicted in dash lines in the FIG. 4 illustration). With this last-mentioned arrangement, the high-pressure gas goes from the conduit 23 at a respective valve 16 into the individual storage device 19', with the gas returning through the same valve 16 for after-expansion operation of the same cylinder. A conventional exhaust manifold 24 leads the exhaust gases away from the low-pressure main discharge valves 17.

Figure 5:
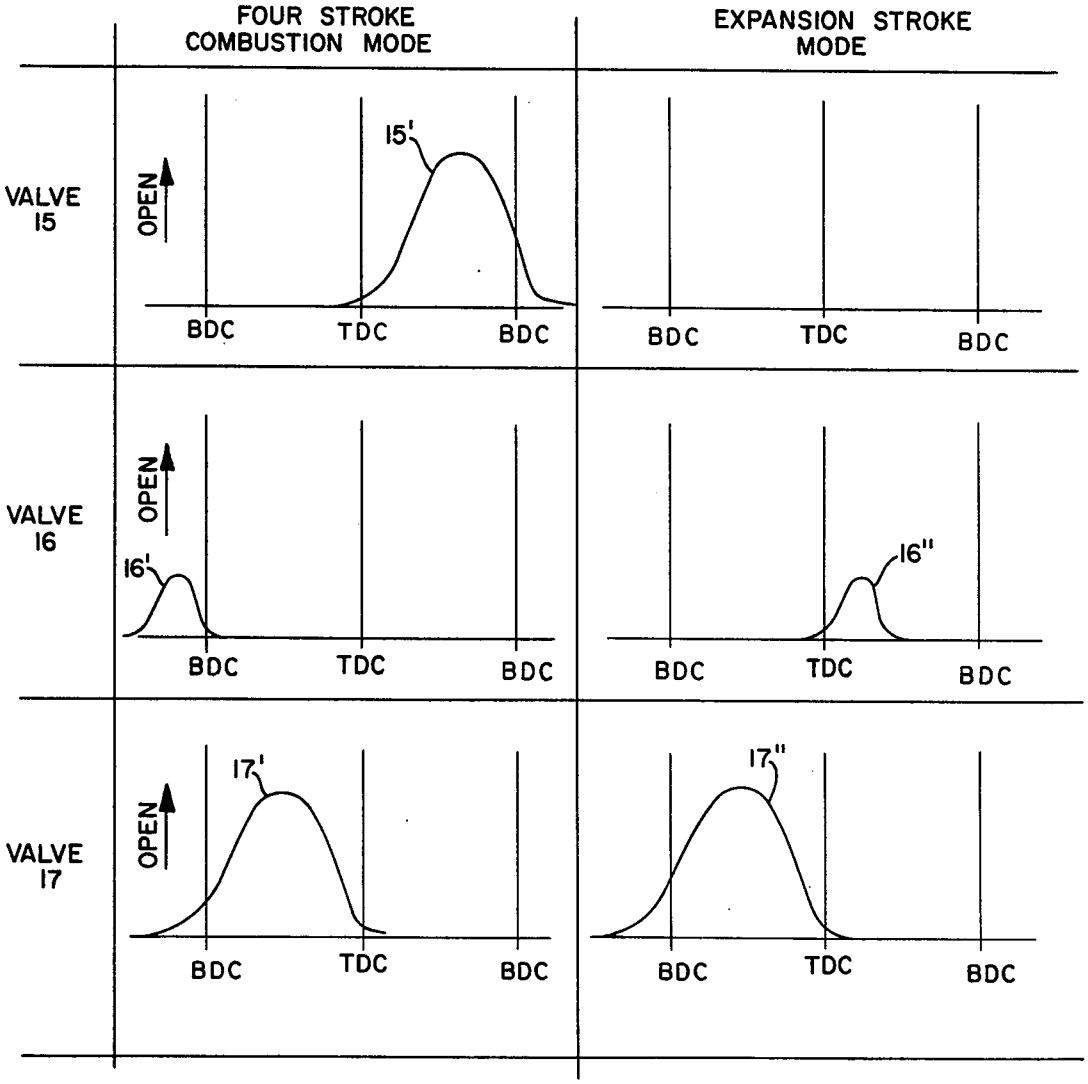
FIG. 5 contains valve lift curves for the valves of the engine constructed in accordance with the FIG. 3 embodiment, showing both four stroke combustion operation and after-expansion operation.

FIG. 5 graphically depicts the course of the valve actuation for each of the valves 15, 16 and 17. The left-hand curves in FIG. 5 depict the opening and closing of the valves 15, 16 and 17 (lift curves 15' 16', and 17'), with reference to the top and bottom dead centers, TDC and BDC, of the pistons in the cylinders 11, 14, during ordinary four-stroke combustion operation. In this phase, only the opening of the high-pressure pre-discharge valve 16 before the opening of the low-pressure main discharge valve 17 is provided in addition to what would be the case with the operation of a normal four-stroke combustion engine not having the valves 16. Before bottom dead center BDC, this valve 16 allows part of the working gas with relatively high residual pressure to flow from the cylinder (for example, 11) out into an intermediate storage device 19 or 19', or via one of conduits 20 over into another cylinder (e.g. 14) through the after-intake valve 16 of the cylinder 14. The low-pressure main discharge valve 17, as depicted in its lift curve 17', allows the remaining part of the working gas to flow off from the cylinder 11. Thereupon, with conventional overlap, conventional intake valve 15, according to its lift curve 15', opens for a new filling of the cylinder. In this mode of four-stroke operation, the valve 16 acts as a pre-discharge valve.

During after-expansion operation, as depicted in the curves on the right-hand side of FIG. 5, the valves 16 operate as after-intake valves. Assuming that the left-hand side of FIG. 5 was depicting the cylinder 11, and the right-hand side depicting cylinder 14, with cylinder 11 operating in a four-stroke combustion process and cylinder 14 operating in the after-expansion phase (compare FIGS. 1*b* through 1*d*), the phase-shifted movement of the piston in cylinder 14 as compared to cylinder 11 will facilitate the operation of valve 16 as an after-intake valve (lift curve 16″). In this way, the working gases with relatively high residual pressure can function in the other cylinder 14 for an after-expansion and a supplementary output. Discharge valve 17, by its subsequent opening according to lift curve 17″, allows the further expanded gas to flow out finally through the exhaust bend or manifold 24.

When operating according to the method depicted in FIGS. *2a* to *2c*, the working gases in the same cylinder in which there is a four-stroke process are further expanded by means of one or more two-stroke after-expansion cycles, subsequent to a four-stroke cycle, the valve lift curves of the right-hand column of FIG. 5 respectively joining (one or more times) the curves of the left-hand column. In each cylinder there are accordingly a total of respective six-stroke or eight-stroke cycles. All pre-discharge valves 16 thereby respectively function as after-intake valves, which lead the working gases that flow into an intermediate storage device 19 or 19′ back into the same cylinder for after-expansion.

In preferred embodiments of the invention, emission of harmful exhaust gases is diminished in both processes in that a rich mixture is used in the work strokes with internal combustion, for $NO_X$ reduction, and for after-expansion, additional air is blown in, so that with the after-expansion it is possible to have after-oxidation of the unburned components of the working gas, increasing the efficiency.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. In a method for the partial load control of an operating internal combustion engine with internal combustion in several working spaces, in which with a decreasing load the number of working strokes with internal combustion is reduced per time unit, the improvement comprising the steps of changing over with a decreasing load an increasing number of the working spaces to an after-expansion operation which includes a number of displacement and after-expansion strokes divisible by two, and feeding working gas which has only incompletely expanded in the non-changed-over working spaces during a respective working stroke with internal combustion, to the changed-over working spaces in lieu of fresh mixture and further expanding the same, wherein the exhaust from the internal combustion in at least one of said several working spaces is divided into a high pressure pre-exhaust and a low pressure exhaust, and in that only said high pressure pre-exhaust is fed to said changed-over working spaces as said working gas.

2. A method according to claim 1, characterized in that at least one of the changed-over working spaces is loaded directly with the incompletely expanded working gas.

3. A method according to claim 1, characterized in that at least one of the changed-over working spaces is loaded with the incompletely expanded working gas by way of an intermediate storage device.

4. In a method of the partial load control of an operating internal combustion engine with internal combustion in several working spaces in which with a decreasing load, the number of working strokes with internal combustion is reduced per time unit, the improvement comprising the step of changing-over all working spaces to an increasingly higher stroke number with a decreasing load by providing an increasing number of re-fill and after-expansion pairs following a respective cycle containing a working stroke with internal combustion, wherein a working gas which has only incompletely expanded in the working spaces during a respective working stroke with internal combustion is used for after-expansion, and that the exhaust from the internal combustion in at least one of said several working spaces is divided into a high pressure pre-exhaust and a low pressure exhaust and in that only said high pressure pre-exhaust is used for after-expansion.

5. A method according to claim 1, 2, 3 or 4, characterized in that a rich mixture is used for the working stroke with internal combustion and air is blown-in prior to the after-expansion.

* * * * *